US007536136B2

(12) United States Patent
Hasegawa et al.

(10) Patent No.: US 7,536,136 B2
(45) Date of Patent: May 19, 2009

(54) IMAGE FORMING APPARATUS AND IMAGE FORMING METHOD

(75) Inventors: Satoshi Hasegawa, Shizuoka-ken (JP); Tadao Kamano, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/425,316

(22) Filed: Jun. 20, 2006

(65) Prior Publication Data

US 2007/0003323 A1 Jan. 4, 2007

(30) Foreign Application Priority Data

Jun. 30, 2005 (JP) ..... 2005-192414

(51) Int. Cl.
*G03G 15/01* (2006.01)
*G03G 15/08* (2006.01)

(52) U.S. Cl. ..... 399/227; 399/53; 399/228

(58) Field of Classification Search ..... 399/226, 399/227, 53, 54, 228
See application file for complete search history.

(56) References Cited

U.S. PATENT DOCUMENTS 5,799,228 A * 8/1998 Iwata et al. ..... 399/94
6,763,202 B2 * 7/2004 Maeda ..... 399/53
2003/0142995 A1 * 7/2003 Suzuki ..... 399/226
2004/0179864 A1 * 9/2004 Masuda ..... 399/226
2005/0281568 A1 * 12/2005 Hashizume ..... 399/27

FOREIGN PATENT DOCUMENTS

JP 5-241420 9/1993
JP 6-19271 1/1994
JP 2004-212894 7/2004

* cited by examiner

*Primary Examiner*—David M Gray
*Assistant Examiner*—Joseph S. Wong
(74) *Attorney, Agent, or Firm*—SoCal IP Law Group LLP; Steven C. Sereboff; John E. Gunther

(57) ABSTRACT

An image forming apparatus includes a rotatable developing device incorporating first developer units, a second developer unit disposed outside the rotatable developing device, a photoconductor on which a toner image can be formed by contact of each of the first and second developer units, and a driving motor for rotating the rotatable developing device. A first value of angular acceleration of the rotatable developing device when development performed by a first one of the first developer units proceeds to development performed by the second developer unit and a second value thereof when the development performed by the second developer unit proceeds to development performed by a second one of the first developer units are set to be smaller than a third value thereof when development performed by the second one of the first developer units proceeds to development performed by a next one of the first developer units.

8 Claims, 6 Drawing Sheets

IMAGE FORMING APPARATUS AND IMAGE FORMING METHOD

This application claims priority from Japanese Patent Application 2005-192414, filed Jun. 30, 2005.

BACKGROUND OF THE INVENTION

1. Field of the Invention

The present invention relates to an image forming apparatus and an image forming method and, in particular, to an image forming apparatus and an image forming method that form a color image by using a rotatable developing device.

2. Description of the Related Art

Generally, image forming apparatuses that form a color image use four colors of toner which consists of three colored toner (cyan, magenta, and yellow) and black toner.

There are various methods for forming a color image by using such four colors of toner. In order to keep size of an image forming apparatus small, a structure is widely used in which four toner developer units or three colored toner developer units are evenly spaced on a rotatable developing device.

For a structure in which three colored toner developer units are arranged on a rotatable developing device, it is necessary to arrange a developer unit for black toner (black developer unit) independently of the rotatable developing device for colored toner. In business offices, the frequency of use of black-and-white images is still predominantly high in most cases. Therefore, in view of supplying black toner, such a structure, in which the black developer unit and the rotatable developing device for colored toner are disposed independently of each other, is advantageous in many respects.

Japanese Unexamined Patent Application Publication Nos. 5-241420 and 6-019271 disclose a technique regarding an image forming apparatus in which a black developer unit and a rotatable developing device for colored toner are disposed independently of each other.

A typical image forming apparatus forms a color image by sequentially superposing images corresponding to four colors of toner on a transfer belt or a transfer drum. Therefore, image formation for a color image requires a longer time than that for a black-and-white image.

For sequential development of each colored toner image using a rotatable developing device, it is necessary to rotate the rotatable developing device every time color is switched. In the case where three colored toner developer units are disposed on the rotatable developing device, since these developer units are spaced 120 degrees apart, the rotatable developing device is required to be rotated 120 degrees every time color is switched among cyan, magenta, and yellow. The time required for this rotation movement is one of the causes of increased time required for color image formation.

The patent documents mentioned above both disclose a technique that aims to reduce the time required for color image formation. For example, Japanese Unexamined Patent Application Publication No. 5-241420 discloses a technique that reduces the time required for color image formation by employing the unnecessity of waiting time for switching when operation shifts from a fixed black developing device to a rotatable developing device and vice versa.

Japanese Unexamined Patent Application Publication No. 6-019271 discloses a technique that reduces the time required for color image formation by using a structure in which an image for one color among the three colors is developed simultaneously with development of an image for black.

For an image forming apparatus in which colored toner developer units are arranged on a rotatable developing device, one of the most effective approaches for reducing the time required for color image formation is to increase the rotation speed of the rotatable developing device.

Rotating the rotatable developing device and thus moving the positions of the three colored toner developer units which are spaced 120° apart in a short time allows delay time associated with color switching to be reduced, resulting in a reduction in the time required for color image formation.

In order to rotate the rotatable developing device in a short time, it is necessary to increase angular acceleration of a driving motor that drives the rotatable developing device.

However, in general, increasing the angular acceleration of the driving motor increases the current consumption and power consumption of the driving motor. Additionally, it increases vibration and noise associated with driving.

SUMMARY OF THE INVENTION

Accordingly, it is an object of the present invention to provide an image forming apparatus and an image forming method that can reduce the angular acceleration of a driving motor for driving a rotatable developing device without increasing time required for color image formation and thus can achieve reduced power consumption and decreased vibration and noise.

According to a first aspect of the present invention, an image forming apparatus includes a rotatable developing device incorporating a plurality of first developer units, a second developer unit disposed outside the rotatable developing device, a photoconductor on which a toner image is capable of being formed by contact of each of the first and second developer units, and a driving motor configured to rotate the rotatable developing device. In the image forming apparatus, a first value of angular acceleration of the rotatable developing device when development performed by a first one of the first developer units proceeds to development performed by the second developer unit and a second value of angular acceleration of the rotatable developing device when the development performed by the second developer unit proceeds to development performed by a second one of the first developer units are set to be smaller than a third value of angular acceleration of the rotatable developing device when development performed by the second one of the first developer units proceeds to development performed by a next one of the first developer units.

According to a second aspect of the present invention, an image forming method for an image forming apparatus including a rotatable developing device incorporating a plurality of first developer units, a second developer unit disposed outside the rotatable developing device, a photoconductor on which a toner image is capable of being formed by contact of each of the first and second developer units, and a driving motor configured to rotate the rotatable developing device is provided. In the image forming method, a first value of angular acceleration of the rotatable developing device when development performed by a first one of the first developer units proceeds to development performed by the second developer unit and a second value of angular acceleration of the rotatable developing device when the development performed by the second developer unit proceeds to development performed by a second one of the first developer units are set to be smaller than a third value of angular acceleration of the rotatable developing device when development performed by the second one of the first developer units proceeds to development performed by a next one of the first developer units.

The image forming apparatus and the image forming method according to the embodiments of the present invention can reduce the angular acceleration of the driving motor for driving the rotatable developing device without increasing the time required for color image formation and thus can achieve reduced power consumption and decreased vibration and noise.

DESCRIPTION OF THE PREFERRED EMBODIMENTS

An image forming apparatus and an image forming method according to preferred embodiments of the present invention are described below with reference to the accompanying drawings.

1. Structures and Fundamental Operations

Figure 1A:
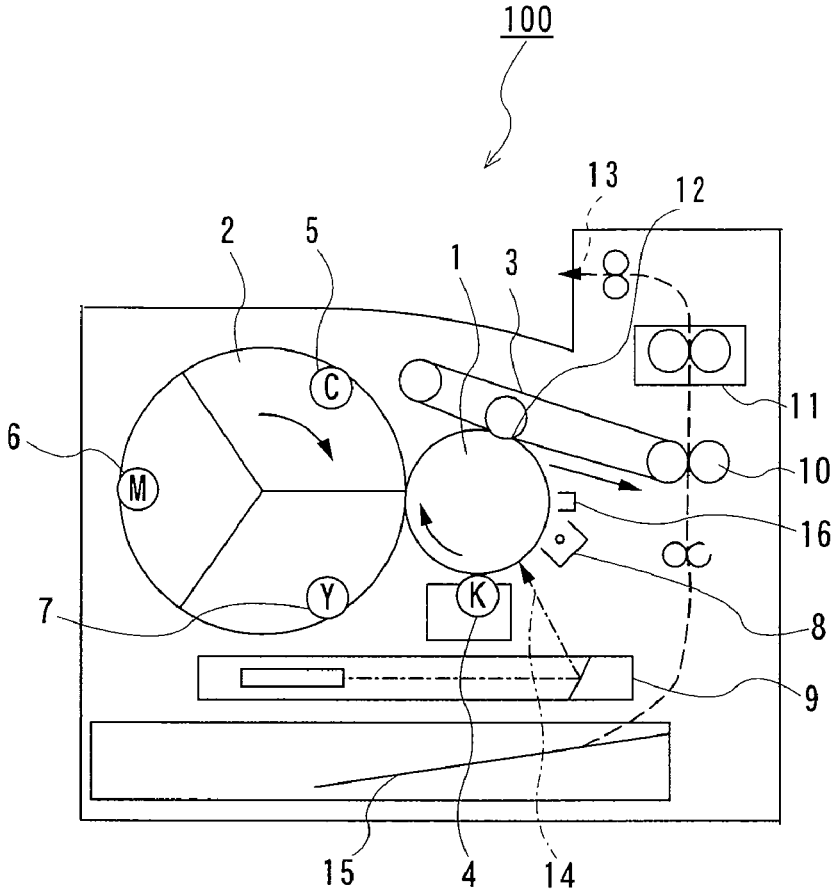
FIGS. 1A and 1B illustrate an exemplary structure of an image forming apparatus according to an embodiment of the present invention.
Figure 1B:
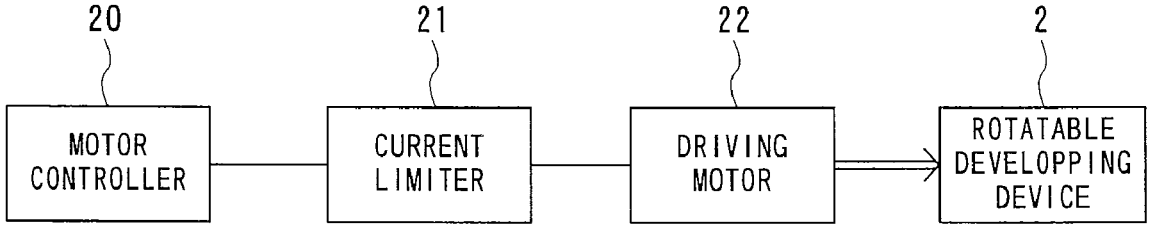

FIGS. 1A and 1B illustrate an exemplary structure of an image forming apparatus 100. FIG. 1A illustrates an exemplary general structure of the image forming apparatus 100. FIG. 1B specifically illustrates an exemplary driving system for driving a rotatable developing device 2 in the image forming apparatus 100.

As illustrated in FIG. 1A, the image forming apparatus 100 includes a photoconductor 1 which forms an electrostatic lament image on a rotation circumference thereof, a black developer unit (second developer unit) 4 which develops a black toner image by coming into contact with the photoconductor 1, the rotatable developing device 2 which incorporates three color developer units (first developer units), i.e., a cyan developer unit 5, a magenta developer unit 6, and a yellow developer unit 7, an intermediate transfer belt 3 which transfers an image developed on the photoconductor 1 thereto via a primary transfer unit 12, a secondary transfer unit 10 which transfers an image transferred on the intermediate transfer belt 3 to printing paper, a fixing unit 11 which fixes an image transferred on the printing paper, and an output unit 13 which outputs the printing paper having the fixed image.

In addition, the image forming apparatus 100 further includes a paper feed unit 15 which supplies printing paper (e.g., a white sheet of paper), a laser unit 9 which emits laser light in response to the strength of image data, a charger 8 which charges the photoconductor 1, an exposing unit 14 which forms an electrostatic lament image on the photoconductor 1 by irradiating the charged photoconductor 1 with the laser light, and a cleaning blade 16 which wipes toner portions that remain on the photoconductor 1 after the image is transferred to the intermediate transfer belt 3.

As shown in FIG. 1B, the driving system for driving the rotatable developing device 2 includes a driving motor 22 and a motor controller 20 which generates a control signal for the driving motor 22. The driving motor 22 is connected to the rotatable developing device 2 via an appropriate connecting mechanism (not shown) and drives the rotatable developing device 2. The driving system may include a current limiter 21 which is disposed between the motor controller 20 and the driving motor 22 and limits a current value of the control signal.

A fundamental operation of image formation in the image forming apparatus 100 having the foregoing structure is described below.

First, the photoconductor 1 is charged by the charger 8. Subsequently, the charged photoconductor 1 is irradiated with laser light that has been emitted from the laser unit 9 via the exposing unit 14, and an electrostatic latent image corresponding to black is formed on the photoconductor 1.

Next, the black developer unit 4 comes into contact with the photoconductor 1, and black toner forms a black toner image on the photoconductor 1. The black toner image formed on the photoconductor 1 is transferred to the intermediate transfer belt 3 at the primary transfer unit 12.

After the black toner image is transferred to the intermediate transfer belt 3, black toner portions remaining on the surface of the photoconductor 1 are removed by the cleaning blade 16. Then, the photoconductor 1 is charged by the charger 8 again.

Subsequently, an electrostatic latent image corresponding to cyan is formed on the photoconductor 1 at the exposing unit 14.

During this time, the black developer unit 4 separates from the photoconductor 1, and the rotatable developing device 2 (also called "revolver") rotates. As a result, the incorporated cyan developer unit 5 moves to a development position of the photoconductor 1 (a position at which the photoconductor 1 and the rotatable developing device 2 are in contact with each other), so that the cyan developer unit 5 comes into contact with the photoconductor 1. Therefore, a cyan toner image is formed on the photoconductor 1.

The cyan toner image formed on the photoconductor 1 is transferred to the intermediate transfer belt 3 at the primary transfer unit 12 so as to be superposed on the black toner image, which has been transferred to the intermediate transfer belt 3 previously.

After the cyan image is transferred to the intermediate transfer belt 3, cyan toner portions remaining on the surface of the photoconductor 1 are removed by the cleaning blade 16. Then, the photoconductor 1 is charged by the charger 8 again.

Subsequently, an electrostatic latent image corresponding to magenta is formed on the photoconductor 1 at the exposing unit 14.

During this time, the rotatable developing device 2 rotates and thus the incorporated magenta developer unit 6 moves to the development position of the photoconductor 1, so that the magenta developer unit 6 comes into contact with and the photoconductor 1. As a result, a magenta toner image is formed on the photoconductor 1.

The magenta toner image formed on the photoconductor 1 is transferred to the intermediate transfer belt 3 at the primary transfer unit 12 so as to be superposed on the cyan and black toner images, which have been transferred to the intermediate transfer belt 3 previously.

In the same manner, a yellow toner image is transferred to the intermediate transfer belt 3 so as to be superposed on the previously transferred images.

The superposed images for all toner colors (black, cyan, magenta, and yellow) transferred on the intermediate transfer belt 3 are transferred from the intermediate transfer belt 3 to printing paper (e.g., a white sheet of paper) at the secondary transfer unit 10, and then fixed on the printing paper at the fixing unit 11. The printing paper with the fixed color images for all toner colors is finally output from the output unit 13.

The fundamental operation of color image formation is described above. A further detailed operation, in particular, a detailed operation regarding the rotation of the rotatable developing device 2 is described below.

2. Detailed Operations

FIGS. 2A to 2E illustrate positional relationships between the rotatable developing device 2 and the black developer unit 4 during color image formation.

Figure 2A:
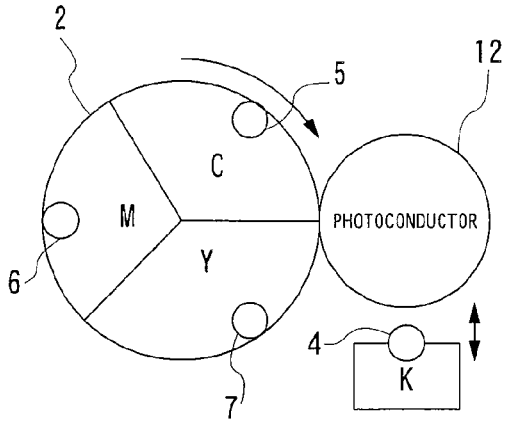
FIGS. 2A to 2E illustrate exemplary positional relationships between a rotatable developing device and a black developer unit in the image forming apparatus according to an embodiment of the present invention.

FIG. 2A illustrates a positional relationship between the rotatable developing device 2 and the black developer unit 4 in a standby state immediately after power on. In this state, the black developer unit 4 is away from the photoconductor 1, and the rotatable developing device 2 is located such that the midpoint between the cyan developer unit 5 and the yellow developer unit 7 is in contact with the photoconductor 1 (development position). The position of the rotatable developing device 2 and the state in which the black developer unit 4 is away from the photoconductor 1 illustrated in FIG. 2A are a home position.

Figure 2B:
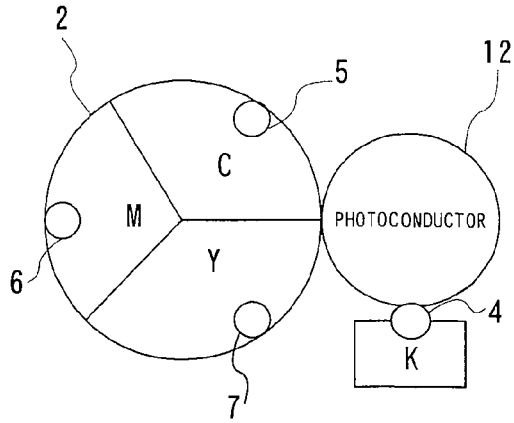

When printing starts, as illustrated in FIG. 2B, the black developer unit 4 comes into contact with the photoconductor 1 and develops the photoconductor 1, thus forming a black toner image on the photoconductor 1.

Figure 2C:
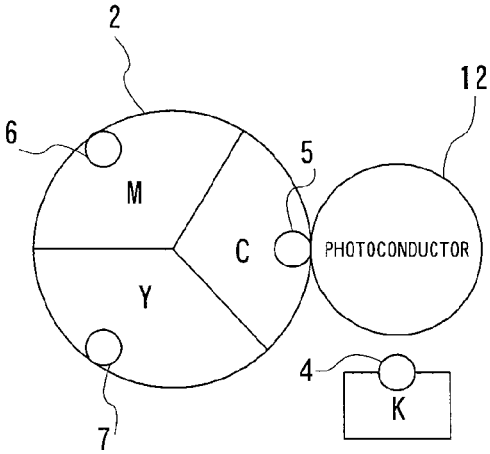

When the development of the black toner image is completed, as illustrated in FIG. 2C, the black developer unit 4 separates from the photoconductor 1, and the rotatable developing device 2 rotates up to a position at which the cyan developer unit 5 comes into contact with the photoconductor 1. At this position, the cyan developer unit 5 comes into contact with the photoconductor 1 and develops the photoconductor 1, thus forming a cyan toner image on the photoconductor 1.

Figure 2D:
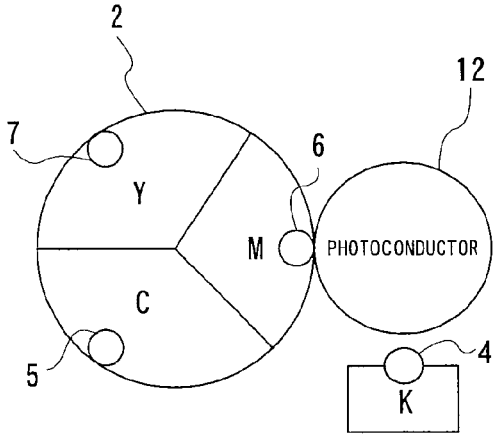

When the development of the cyan toner image is completed, as illustrated in FIG. 2D, the rotatable developing device 2 rotates up to a position at which the magenta developer unit 6 comes into contact with the photoconductor 1. At this position, the magenta developer unit 6 comes into contact with the photoconductor 1 and develops the photoconductor 1, thus forming a magenta toner image on the photoconductor 1.

Figure 2E:
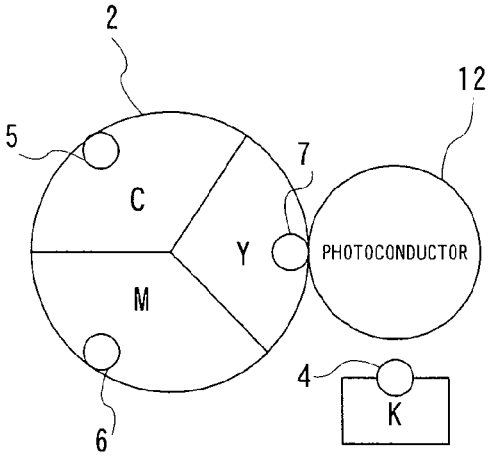

When the development of the magenta toner image is completed, as illustrated in FIG. 2E, the rotatable developing device 2 rotates up to a position at which the yellow developer unit 7 comes into contact with the photoconductor 1. At this position, the yellow developer unit 7 comes into contact with the photoconductor 1 and develops the photoconductor 1, thus forming a yellow toner image on the photoconductor 1.

The black, cyan, magenta, yellow toner images are sequentially superposed and transferred to the intermediate transfer belt 3 at the primary transfer unit 12, and the completion of transfer of the yellow toner image to the intermediate transfer belt 3 means that the toner images for all toner colors have been transferred to the intermediate transfer belt 3. At this time, the toner images for all toner colors on the intermediate transfer belt 3, i.e., a mixed color image is transferred to printing paper at the secondary transfer unit 10, fixed at the fixing unit 11, and then the printing paper is output.

If the number of sheets to be printed is one, the rotatable developing device 2 returns from the state illustrated in FIG. 2E to the home position illustrated in FIG. 2A, and the printing is completed.

If continuous printing is needed, the rotatable developing device 2 returns from the state illustrated in FIG. 2E to that in FIG. 2B. In the state illustrated in FIG. 2B, the rotatable developing device 2 is located such that the midpoint between the cyan developer unit 5 and the yellow developer unit 7 lies in the development position (home position for the rotatable developing device 2) and the black developer unit 4 is in contact with the photoconductor 1. From the state illustrated in FIG. 2B, the development of a next black toner image starts immediately.

Figure 3A:
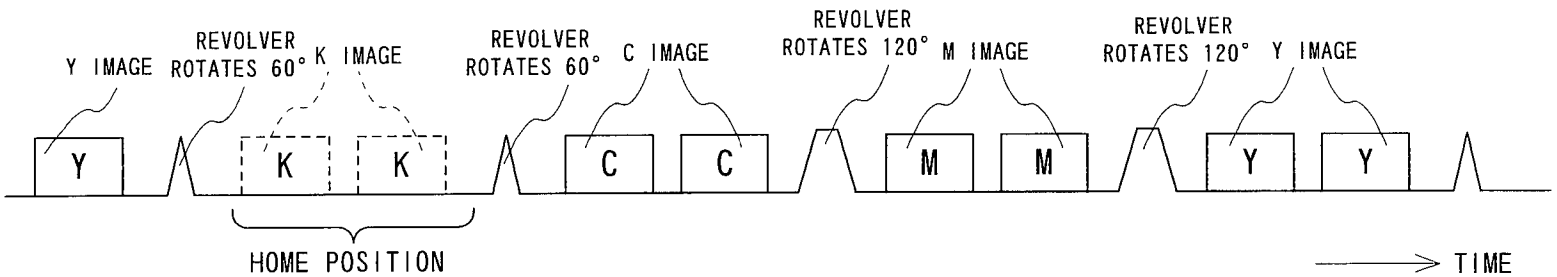
FIG. 3A (PRIOR ART)
FIGS. 3A and 3B illustrate rotation states of a rotatable developing device and forming states of toner images in a conventional image forming apparatus.
Figure 3B:
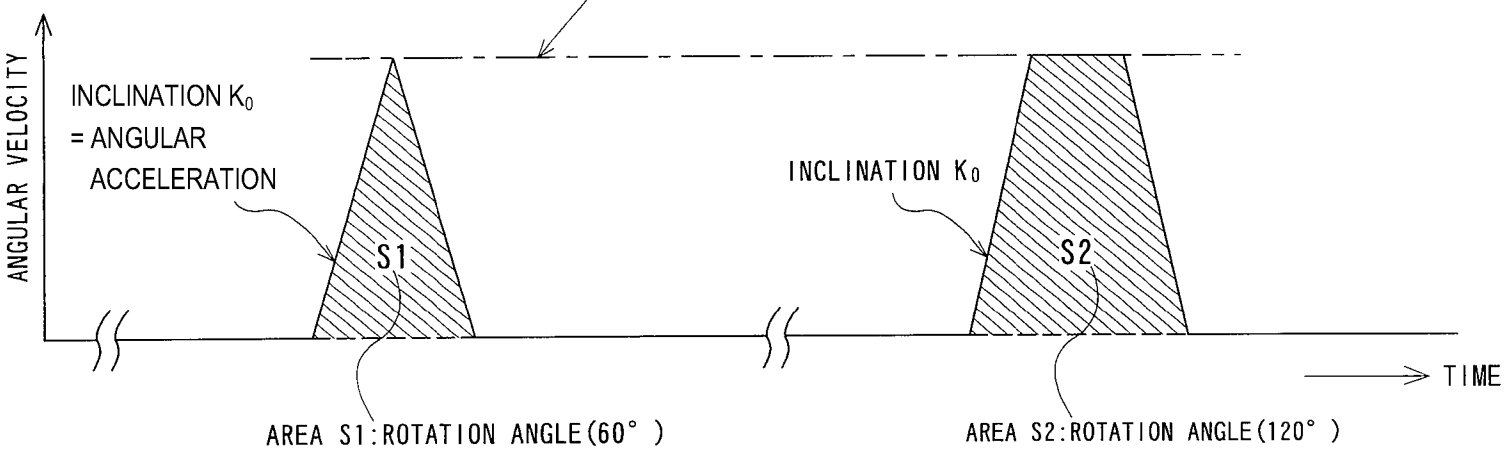
FIG. 3B (PRIOR ART)

FIGS. 3A and 3B illustrate a conventional operation sequence and a relationship between the rotation states of the rotatable developing device 2 and the forming states of toner images on the photoconductor 1.

FIG. 3B illustrates only the rotation states of the rotatable developing device 2, and FIG. 3A is an illustration in which the rotation states of the rotatable developing device 2 and the forming states of the toner images are superposed on each other.

In FIG. 3B, the horizontal axis represents time, and the vertical axis represents rotational angular velocity of the rotatable developing device 2. A state in which the angular speed is zero indicates that the rotatable developing device 2 does not rotate. Each of the regions of a triangular shape and a trapezoidal shape illustrated in FIG. 3B indicates that the rotatable developing device 2 rotates. The inclination of each of the triangular shape and the trapezoidal shape, $K_0$, represents the magnitude of angular acceleration of the rotatable developing device 2 during rotation. Each of the area of the triangular shape, S1, and the area of the trapezoidal shape, S2, represents a rotation angle of the rotatable developing device 2. More specifically, when S1 is 60 degrees, the rotatable developing device 2 rotates 60 degrees in a period from a time that corresponds to the leading end of the triangular shape to a time that corresponds to the trailing end thereof. Similarly, when S2 is 120 degrees, the rotatable developing device 2 rotates 120 degrees in a period from a time that corresponds to the leading end of the trapezoidal shape to a time that corresponds to the trailing end thereof.

In consideration of this movement of the rotatable developing device 2, the left-end portion of FIG. 3A illustrates a period of time during development of a Y image (yellow toner image) on the photoconductor 1. During the period, the rotatable developing device 2 does not rotate. This period corresponds to the state illustrated in FIG. 2E.

When the development of the Y image is completed, the rotatable developing device 2 starts rotating with a characteristic of the angular velocity of the triangular shape (angular acceleration $K_0$). When the rotatable developing device 2 rotates 60 degrees, the rotatable developing device 2 stops. After the rotatable developing device 2 stops, development of a K image (black toner image) starts. FIG. 3A illustrates an exemplary state in which two documents are simultaneously printed, for example, two A4-size documents placed on a document placement table side by side are printed. Therefore, while the rotatable developing device 2 does not rotate, two K images appear in succession. A period of time while the K images are formed corresponds to the state illustrated in FIG. 2B.

When the development of the two K images is completed, the rotatable developing device 2 starts rotating with a characteristic of the angular velocity of the triangular shape (angular acceleration $K_0$) again. When the rotatable developing device 2 rotates 60 degrees, the rotatable developing device 2 stops again. After the rotatable developing device 2 stops, development of two C images (cyan toner images) starts. This period corresponds to the state illustrated in FIG. 2C.

When the development of the two C images is completed, the rotatable developing device 2 starts rotating with a characteristic of the angular velocity of the trapezoidal shape (angular acceleration $K_0$) again. When the rotatable developing device 2 rotates 120 degrees, the rotatable developing device 2 stops again. After the rotatable developing device 2 stops, development of two M images (magenta toner images) starts. This period corresponds to the state illustrated in FIG. 2D.

When the development of the two M images is completed, the rotatable developing device 2 starts rotating with a characteristic of the angular velocity of the trapezoidal shape (angular acceleration $K_0$) again. When the rotatable developing device 2 rotates 120 degrees, the rotatable developing device 2 stops again. After the rotatable developing device 2 stops, development of two Y images (yellow toner images) starts. This period corresponds to the state illustrated in FIG. 2E. Repeating the cycle described above forms a mixed color image in a conventional operation sequence.

In the conventional sequence illustrated in FIG. 3A, the rotatable developing device 2 finishes moving to the home position before the development of a K image starts. In other words, according to the illustrated conventional sequence, the rotatable developing device 2 moves to the home position, the rotatable developing device 2 stops moving, and then the development of the K image starts.

However, the effective use of a structure in which the rotatable developing device 2 which develops images for colored toner is physically separate from the black developer unit 4 which develops an image for black toner allows a transition sequence from the end of the development of a Y image to returning to the home position and that from the home position to the development of a C image to be improved.

Figure 4:
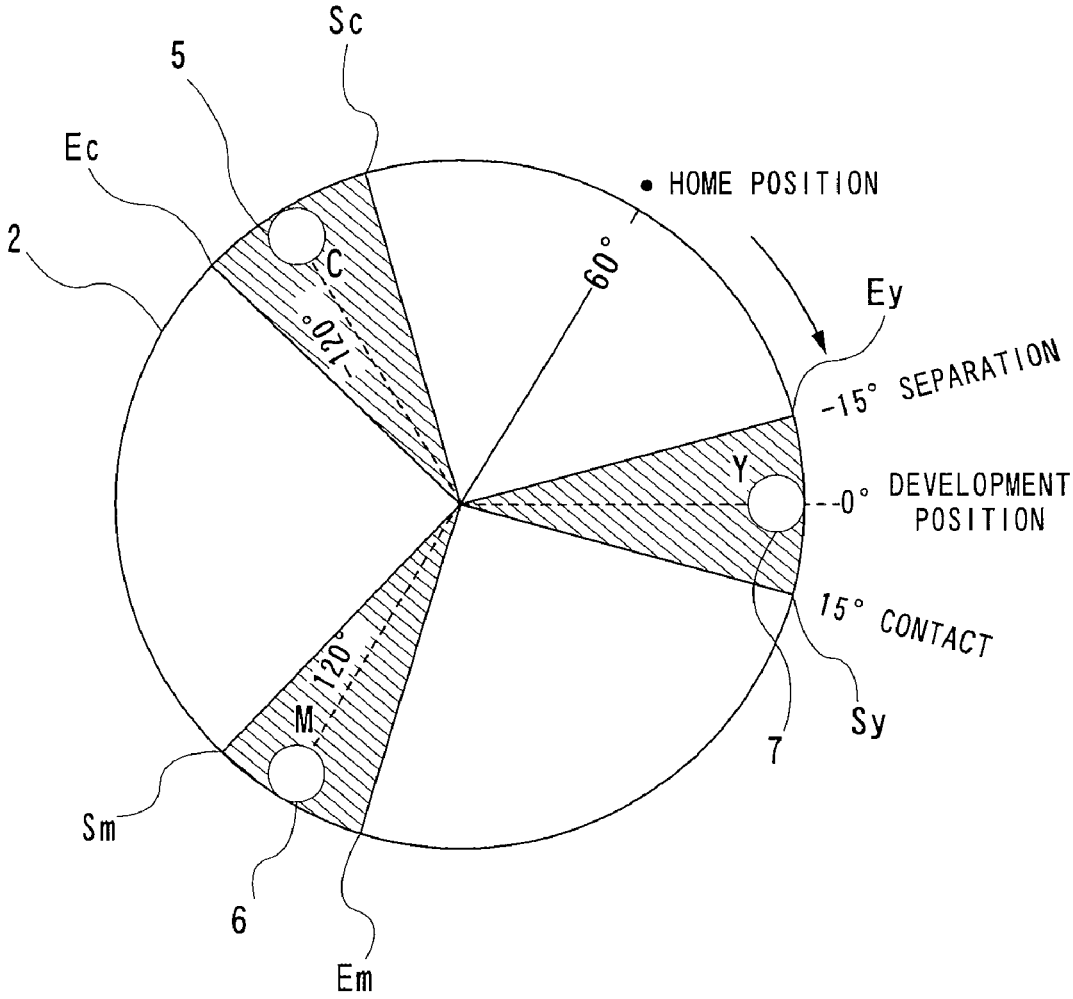
FIG. 4 illustrates an exemplary arrangement of colored toner developer units (color developer units) in the image forming apparatus according to an embodiment of the present invention.

FIG. 4 illustrates exemplary positions of the cyan developer unit 5, the magenta developer unit 6, and the yellow developer unit 7 in the rotatable developing device 2 and exemplary ranges of where each developer unit is in contact with the photoconductor 1.

In the case where the cyan developer unit 5, the magenta developer unit 6, and the yellow developer unit 7 are evenly spaced in the rotatable developing device 2, these developer units are spaced 120 degrees apart. When these developer units rotate and come into contact with the photoconductor 1, a certain contactable range from when each developer unit starts coming into contact with the photoconductor 1 to when the developer unit fully separates from the photoconductor 1. The contactable range may be, for example, a range of the position of each developer unit ±approximately 15 degrees.

Therefore, if the rotation of the rotatable developing device 2 is controlled such that a positional relationship in which the contactable range and a K image that is developed on the photoconductor 1 by the black developer unit 4 do not interfere with each other is maintained, the developed K image has no adverse effect.

FIGS. 5A to 5D are illustrations for explaining rotation control of the rotatable developing device 2 in the image forming apparatus 100 according to an embodiment based on this approach.

Figure 5A:
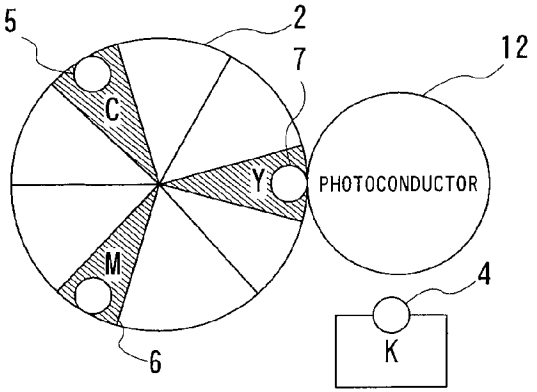
FIGS. 5A to 5D are first illustrations for explaining a rotation operation of the rotatable developing device in the image forming apparatus according to an embodiment of the present invention.
Figure 5B:
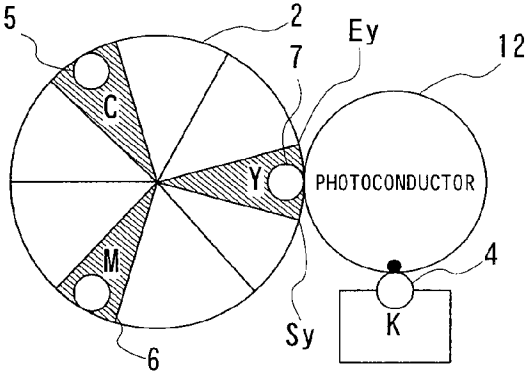

FIG. 5A illustrates a state in which a Y image is developed, and this state corresponds to FIG. 2E. When the development of the Y image is completed, in order to develop a K image, the black developer unit 4 comes into contact with the photoconductor 1. This is illustrated in FIG. 5B.

In a conventional technique, at this stage, i.e., while development performed by the yellow developer unit 7 (first developer unit) proceeds to development performed by the black developer unit 4 (second developer unit), the rotation of the rotatable developing device 2 is controlled such that the movement of the rotatable developing device 2 up to the home position has been completed. In contrast to the conventional technique, according to the embodiment, the rotatable developing device 2 moves as "slowly" as possible.

Figure 5C:
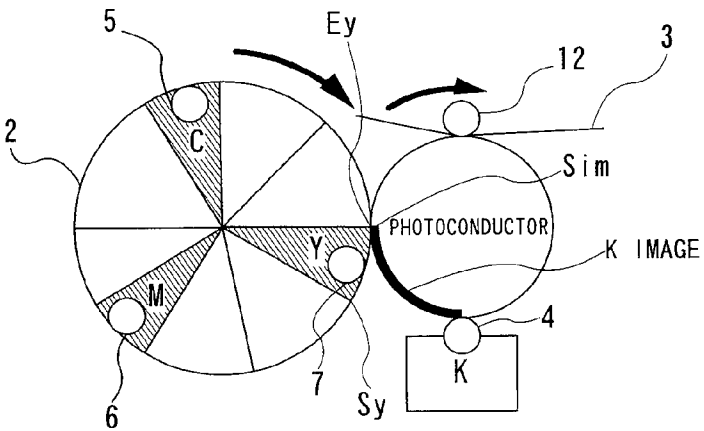

A K image (black toner image) is formed on the photoconductor 1 together with the rotation of the photoconductor 1. If the trailing end of the contactable range around the yellow developer unit 7 (the range of where the yellow developer unit 7 starts coming into contact with the photoconductor 1 to where the yellow developer unit 7 fully separates from the photoconductor 1), Ey, passes through the development position before the leading end of the formed K image, Sim, reaches the development position, the K image and the contactable range do not interfere with (do not overlap) each other. This is illustrated in FIG. 5C.

Figure 5D:
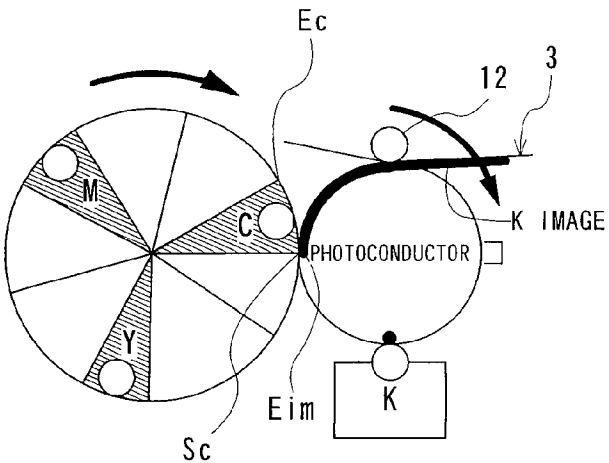

While development performed by the black developer unit 4 (second developer unit) proceeds to development performed by the cyan developer unit 5 (first developer unit), if the trailing end of the K image on the photoconductor 1, Eim, passes through the development position before the leading end of the contactable range around the cyan developer unit 5, Sc, reaches the development position, the K image and the contactable range do not interfere with (do not overlap) each other. This is illustrated in FIG. 5D.

As described above, controlling the rotation of the rotatable developing device 2 such that the contactable range of each of the yellow developer unit 7 and the cyan developer unit 5 and the K image formed by the black developer unit 4 do not interfere with each other allows the rotatable developing device 2 to rotate "slowly" while the development of the Y image proceeds to the development of the K image and while that of the K image proceeds to that of the C image.

Figure 6A:
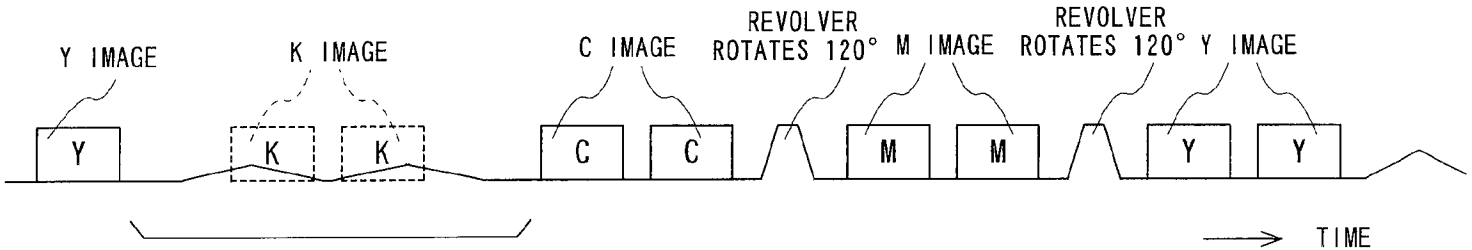
FIGS. 6A to 6C are second illustrations for explaining the rotation operation of the rotatable developing device in the image forming apparatus according to an embodiment of the present invention.
Figure 6B:
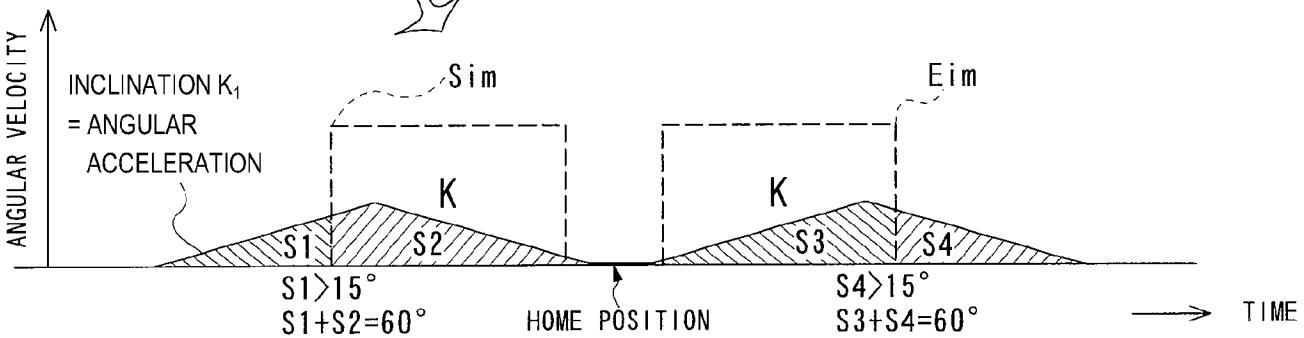
Figure 6C:
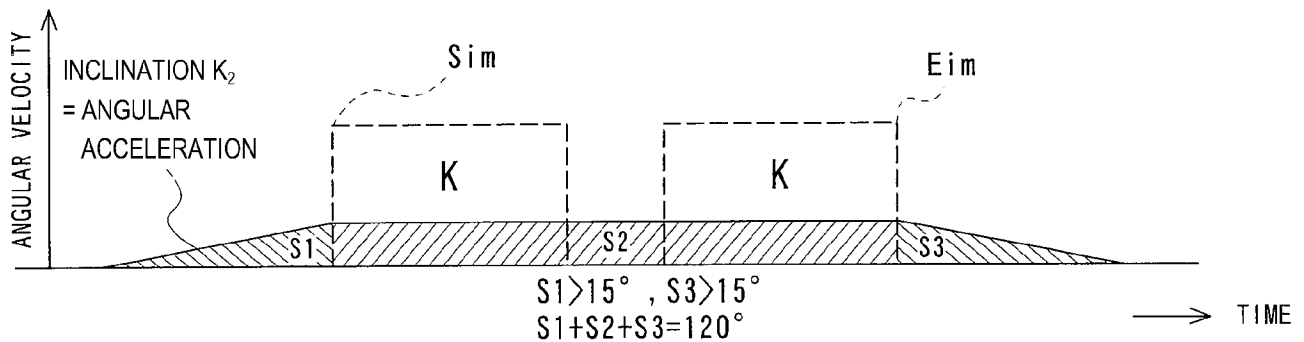

FIGS. 6A to 6C are illustrations for explaining exemplary rotation control operations of the rotatable developing device 2 according to the embodiment. FIGS. 6A and 6B illustrate a first rotation control operation, and FIG. 6C illustrates a second rotation control operation.

In the first operation, the rotatable developing device 2 temporarily stops at the home position. In the second operation, the rotatable developing device 2 continues rotating without stopping at the home position. Both rotation control operations reduce angular acceleration, compared with a conventional technique.

Each of the areas S1 illustrated in FIGS. 6B and 6C represents a rotation angle of the rotatable developing device 2 up to when the leading end of a K image reaches the development position. Controlling the rotation of the rotatable developing device 2 such that S1 is larger than approximately 15 degrees can avoid the contactable range around the yellow developer unit 7 (approx. ±15 degrees) and the K image from overlapping each other, i.e., from interfering with each other.

Each of the area S4 illustrated in FIG. 6B and the area S3 in FIG. 6C represents a rotation angle of the rotatable developing device 2 from when the trailing end of the K image passes through the development position to when the rotatable developing device 2 stops. Controlling the rotation of the rotatable developing device 2 such that S4 is larger than approximately 15 degrees in FIG. 6B and such that S3 is larger than approximately 15 degrees in FIG. 6C can avoid the contactable range around the cyan developer unit 5 (approx. ±15 degrees) and the K image from overlapping each other, i.e., from interfering with each other.

A comparison of FIGS. 6A to 6C with FIGS. 3A and 3B obviously indicates that both of the values of the angular acceleration, $K_1$ and $K_2$, of the rotatable developing device 2 according to the embodiment are smaller than the value of the angular acceleration $K_0$ according to the conventional technique.

In the embodiment, while development of a Y image proceeds to development of a K image and while the development of the K image proceeds to development of a C image, although the angular acceleration of the rotatable developing device 2 is reduced, the overall time required to form a mixed color image itself is substantially the same as that in a conventional technique. Therefore, a color image forming time equivalent to that in a conventional technique can be realized.

As described above, the image forming apparatus 100 according to the embodiments can reduce the angular acceleration of the driving motor 22 for driving the rotatable developing device 2 without increasing the time required for color image formation. As a result, the current consumption of the driving motor 22 can be reduced, thus allowing the overall power consumption of the image forming apparatus 100 to be reduced.

Additionally, the reduction in the angular acceleration of the driving motor 22 can reduce vibration and noise resulting from the driving motor 22.

The current limit of the current limiter 21 may be reduced together with the reduction in the current consumption of the driving motor 22.

One object to provide the current limiter 21 used for the driving motor 22 is to protect the driving motor 22 from an overcurrent. Reducing the current limit with a reduction in the current consumption of the driving motor 22 allows a margin of such a protection of the current limiter 21 to be set appropriately.

The present invention is not limited to the embodiments described above. In implementation phase, all modifications of the elements can be made concrete without departing from the spirit and scope of the present invention. In addition, appropriate combinations of the elements disclosed in the embodiments can form various inventions. For example, one or more elements among all the elements shown in the embodiments can be omitted. Furthermore, the elements can be appropriately combined over the different embodiments.

What is claimed is:

1. An image forming apparatus comprising:

a rotatable developing device incorporating a plurality of first developer units;

a second developer unit disposed outside the rotatable developing device;

a photoconductor on which a toner image is capable of being formed by contact of each of the first and second developer units;

a driving motor configured to rotate the rotatable developing device; and a motor controller configured to control the rotation of the rotatable developing device by the driving motor so that the toner image is formed on the photoconductor by the second developer unit first, then the toner image is formed on the photoconductor by each of the first plurality of developer units sequentially, wherein the motor controller controls to rotate the rotatable developing device with a first angular acceleration while development is performed by the second developer unit, and controls to rotate the rotatable developing device with a second angular acceleration when development is performed by one of the plurality of first developer units proceeds to development by a next one of the plurality of first developer units, and wherein the first angular acceleration is set to be smaller than the second angular acceleration.

2. The image forming apparatus according to claim 1, wherein the first angular acceleration of the rotatable developing device is set such that the trailing end of the range from where the one of the plurality of first developer units comes into contact with the photoconductor to where the next one of the plurality of first developer units separates from the photoconductor does not overlap the leading end of a toner image that is developed on the photoconductor by the second developer unit.

3. The image forming apparatus according to claim 1, wherein the angular acceleration of the rotatable developing device is set such that the leading end of the range from where the one of the plurality of first developer units comes into contact with the photoconductor to where the next one of the plurality of first developer units separates from the photoconductor does not overlap the trailing end of a toner image that is developed on the photoconductor by the second developer unit.

4. The image forming apparatus according to claim 1, further comprising:

a current limiter configured to limit a current of the driving motor, wherein a first current limit of the current limiter, the first current limit being set while the development is performed by the second developer unit, is set to be smaller than a second current limit of the current limiter, the second current limit being set when the development performed by the one of the plurality of first developer units proceeds to the development performed by the next one of the plurality of first developer units.

5. An image forming method for an image forming apparatus comprising a rotatable developing device incorporating a plurality of first developer units, a second developer unit disposed outside the rotatable developing device, a photoconductor on which a toner image is capable of being formed by contact of each of the first and second developer units, a driving motor configured to rotate the rotatable developing device, and a motor controller configured to control the rotation of the rotatable developing device by the driving motor so that the toner image is formed on the photoconductor by the second developer unit first, then the toner image is formed on the photoconductor by each of the first plurality of developer units sequentially, wherein the motor controller controls to rotate the rotatable developing device with a first angular acceleration while development is performed by the second developer unit, and controls to rotate the rotatable developing device with a second angular acceleration when development is performed by one of the plurality of first developer units proceeds to development by a next one of the plurality of first developer units, and wherein the first angular acceleration is set to be smaller than the second angular acceleration.

6. The image forming method according to claim 5, wherein the first angular acceleration of the rotatable developing device is set such that the trailing end of the range from where the one of the plurality of first developer units comes into contact with the photoconductor to where the next one of the plurality of first developer units separates from the photoconductor does not overlap the leading end of a toner image that is developed on the photoconductor by the second developer unit.

7. The image forming method according to claim 5, wherein the first angular acceleration of the rotatable developing device is set such that the leading end of the range from where the one of the plurality of first developer units comes into contact with the photoconductor to where the next one of the plurality of first developer units separates from the photoconductor does not overlap the trailing end of a toner image that is developed on the photoconductor by the second developer unit.

8. The image forming method according to claim 5, wherein the image forming apparatus further comprises a current limiter configured to limit a current of the driving motor, and wherein a first current limit of the current limiter, the first current limit being set while development is performed by the second developer unit, is set to be smaller than a second current limit of the current limiter, the second current limit being set when the development performed by the one of the plurality of first developer units proceeds to the development performed by the next one of the plurality of first developer units.

* * * * *